US006032600A

United States Patent [19]

Burdick

[11] Patent Number: 6,032,600

[45] Date of Patent: Mar. 7, 2000

[54] WEIGHTED DAGGERBOARD STABILIZER FOR WIND SURFING APPARATUS

[76] Inventor: James F. Burdick, 338 Dumbarton Rd., Baltimore, Md. 21212

[21] Appl. No.: 09/018,845

[22] Filed: Feb. 6, 1998

Related U.S. Application Data

[63] Continuation-in-part of application No. 08/795,210, Feb. 5, 1997, Pat. No. 5,784,976.

[60] Provisional application No. 60/054,416, Jul. 31, 1997.

[51] Int. Cl.[7] ..... B63B 35/79

[52] U.S. Cl. ..... 114/39.12; 114/39.15

[58] Field of Search ..... 114/39.11, 39.12, 114/39.13, 39.14, 39.15, 39.16, 127, 129, 130, 132, 138, 139, 140, 141; 441/79

[56] References Cited

U.S. PATENT DOCUMENTS

| | | |
|---|---|---|
| 602,684 | 4/1898 | Henry . |
| 2,466,006 | 4/1949 | Danko . |
| 3,291,088 | 12/1966 | Klose . |
| 3,381,648 | 5/1968 | Vonck . |
| 3,747,550 | 7/1973 | Stoeberl . |
| 4,331,093 | 5/1982 | Moller . |
| 4,508,046 | 4/1985 | Coulter et al. . |
| 4,667,615 | 5/1987 | Marker . |
| 4,715,304 | 12/1987 | Steinberg . |
| 5,069,648 | 12/1991 | Ozeki . |
| 5,129,344 | 7/1992 | Ono et al. . |

FOREIGN PATENT DOCUMENTS

| | | |
|---|---|---|
| 2405864 | 5/1979 | France . |
| 2464181 | 3/1981 | France . |
| 3830820 | 3/1990 | Germany . |

*Primary Examiner*—Stephen Avila
*Attorney, Agent, or Firm*—Lowe Hauptman Gopstein Gilman & Berner

[57] ABSTRACT

A wind surfing apparatus formed with a hull supporting a mast and sail includes a removable daggerboard having a weighted mass in a lower end portion thereof to lessen the tendency of the hull to be unstable or flip during use. The weighted mass may either be integrally molded into the daggerboard lower portion such as with fiberglass materials, or may be releasably attached to the daggerboard to allow for selection of a desired amount of weight. The wind surfer apparatus 10 further includes a ratchet mechanism for controllably selecting and maintaining a desired orientation of the daggerboard stabilizer relative to the hull during use. A hinge connects the mast to the hull through two separate connecting mechanisms. One of the connecting mechanisms between the hinge and mast permits pivotal movement of the mast/sail unit in the plane of the sail only. The other connecting mechanism between the hinge and hull enables rotation of the mast/sail unit about the mast axis only.

11 Claims, 12 Drawing Sheets

Handles
2"
610
1"
Pivot
Knob
7/8"
1/2"
3/4"

Open
606
605
Handle
602
612
614
4 1/2"
616
Fiberglass

28"
600
3"
4 Machine Screws
20
Lead
3/4" Thick
64 cu"

WEIGHTED DAGGERBOARD STABILIZER FOR WIND SURFING APPARATUS

RELATED APPLICATIONS

The present application is a continuation-in-part of application Ser. No. 08/795,210 filed Feb. 5, 1997, now U.S. Pat. No. 5,784,976 entitled "Weighted Daggerboard Stabilizer for Wind Surfing Apparatus" and claims priority from provisional patent application Ser. No. 60/054,416, filed Jul. 31, 1997, entitled "Uniplane Windsurfer Mast-Hull Joint", which is incorporated herein by reference.

TECHNICAL FIELD

The present invention relates generally to wind surfing apparatus and, more particularly, to wind surfing apparatus employing retractable daggerboards, these terms being used interchangeably herein.

BACKGROUND ART

Wind surfing apparatus are generally formed with a hull to which a mast and sail are pivotally mounted to project upward from the hull during sailing. The hull is usually in the form of a sail board having a somewhat flat top surface upon which the user stands in counterbalanced relationship to the sail, and a lower surface which is hydrodynamically formed to move through the water under sail power. At appropriate speeds, the hull is capable of hydroplaning as is well known.

A removable daggerboard projects downward from the hull, rearwardly of the mast, to counterbalance the wind force acting upon the sail when the wind is from the side or the front of the board; the conventional daggerboard also provides a small degree of rotational stability about the long axis of the board.

The daggerboard is constructed and arranged to be removably mounted on the hull in a manner enabling rapid mounting and de-mounting while also being rigidly secured in use. This is often achieved by providing a through slot in the central portion of the hull that communicates with top and bottom surfaces thereof. The lower end of the daggerboard is inserted into the open top of the slot and slides downwardly until restrained by a pair of pivot protrusions which are received and cradled within a pair of shallow depressions formed in the top surface of the board in communication with the slot. These pivot protrusions define a transverse pivot axis located perpendicular to the longitudinal axis of the hull.

One of problems associated with the conventional daggerboard described hereinabove is that the lower end moving through the water is hydrodynamically shaped and somewhat light in weight and therefore cannot easily resist the tendency of the board to be unstable by rolling along its longitudinal axis or to actually flip over. The tendency of the hull to be unstable is a particular problem for novice board sailors and frequently is a sufficient source of frustration for the novice sailor so as to discourage board sailing instruction. The problem of tipping or flipping also plagues intermediate level sailors particularly when learning to do beach starts, water starts and jibes.

It is accordingly an object of the present invention to resist the tendency of wind surfing apparatus to flip.

Another object of the invention is to improve rotational stability of wind surfing apparatus.

Since the aforementioned daggerboard is removable and mounted to the hull by simple downward placement through the open vertical slot, there is a tendency for the lower submerged end of the daggerboard to pivot rearwardly during sailing which lessens its ability to counteract the wind force acting upon the sail, thereby increasing the tendency of the board to flip especially at higher speeds. To prevent this problem, the sailor must constantly or at periodic intervals apply pressure to the upper portion of the daggerboard to ensure that the daggerboard remains in its lowermost position during sailing.

In contrast to the problem identified hereinabove, advanced sailors may desire to pivot the daggerboard into different orientations relative to the hull in order to practice advanced maneuvers or to accomplish beach starts under conditions of shallow depth and gradual bottom slopes where considerable horizontal distances must be traversed before the daggerboard can be pivoted into its lowermost and deepest position.

A further object is to positively control the orientation of the removable daggerboard relative to the hull.

Another object is to prevent pivotal movement of the daggerboard during sailing by positively maintaining the daggerboard at a fixed orientation with respect to the hull irrespective of sail speeds.

SUMMARY OF THE INVENTION

The present invention is directed to a wind surfer apparatus comprising a hull board with a mast and sail mounted to project upward from the hull during sailing. The mast may be conventional and centrally universally pivotally mounted on the top of the hull board by a conventional universal joint mast mounting assembly. A daggerboard is removably mounted to project downward from the hull into the water during sailing. The daggerboard acts to inhibit lateral movement of the hull in response to the force on the sail, producing with the forward force on the sail a resultant force vector that drives the rig forward, in the same manner that a keel of a boat acts. It also acts to stabilize the hull while resisting the tendency of the apparatus to roll or flip about its longitudinal axis during sailing.

In accordance with the present invention, a weight is attached to the submerged end of the daggerboard to advantageously lessen the tendency of the wind surfer apparatus to oscillate about the board's long axis, or flip, during use.

The weight may be secured to the lower end of the daggerboard in a variety of ways. For example, a fixed amount of weight may be integrally molded into the daggerboard lower end by the use of an encapsulation material, such as fiberglass. Alternatively, or in conjunction therewith, a predetermined amount of weight may be attached to the daggerboard lower end using either mechanical fasteners or clamping mechanisms (e.g., of the quick-release type) or a combination of both so that the user may adjust the amount of weight in the daggerboard during set-up to allow for beach conditions.

A cavity opening to one edge of the weight receives the lower end of the daggerboard which may be retained within the cavity by means of screws or the like. The exterior shape of the weight is preferably designed to provide appropriate hydrodynamic characteristics during sailing movement. The cavity is preferably formed to communicate with the top edge of the weight so that this cavity shape and size may be formed in any number of different weighted masses for selective attachment to the lower end of the same daggerboard. For example, by forming the same size cavity in weights of different masses, the sailor may select for use a weight having a mass in a practical range from about 5–50 pounds.

In accordance with another feature of this invention, there is provided a means for fixing the relative orientation of the removable daggerboard relative to the hull. Such fixing means enables the daggerboard to pivot within a longitudinal vertical plane extending perpendicular to the top surface of the hull to assume selected angles of inclination relative to the longitudinal axis. The fixing means is further movable into a neutral position out of positive contact with the daggerboard to enable the sailor to select either positive control or provide the sailor with the ability to control the daggerboard orientation in a conventional manner.

In a preferred embodiment, the fixing means includes a ratchet mechanism pivotally mounted to the top surface of the hull in spaced relation to the daggerboard pivot axis. The ratchet mechanism carries a pawl engageable with at least one of a series of ratchet protrusions formed in an upper portion of the daggerboard. The pawl is resiliently biased into a selected protrusion by means of a pair of tension springs. Tension is transmitted to the springs by appropriate adjustment of a handle assembly operatively connected to the springs.

The weighted daggerboard and ratchet mechanism features may be used either independently or in conjunction with each other.

In accordance with another unique feature of this invention, a hinge is provided between the hull upper surface and mast to permit movement of the sail by the user only in the plane of the sail. A separate connection with between a lower portion of the hinge with the hull permits the hinge to be rotatable through 360° about a rotational axis preferably co-axial with the mast axis In this manner, the sail-hull orientation necessary to move a wind surfer efficiently on all points (e.g., tacking, reaching and running) can be resolved into a 360° rotation of the mast/sail unit about the mast/sail axis, and tilting preferably from 45° back to 45° forward of the vertical in the single vertical plane defined by the sail.

The invention also encompasses a unique weighted daggerboard formed with a universal mount of a resilient or elastomeric material that slides onto the daggerboard to sit within the hull slot and prevent vibration of the daggerboard from being transmitted to the hull. The universal mount also features an upper flange that covers the slot and provides a resting surface for a pair of transversely extending cylindrical projections attached to the upper portion of the daggerboard so as to seat the daggerboard within the slot.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR CARRYING OUT THE INVENTION

Figure 1:
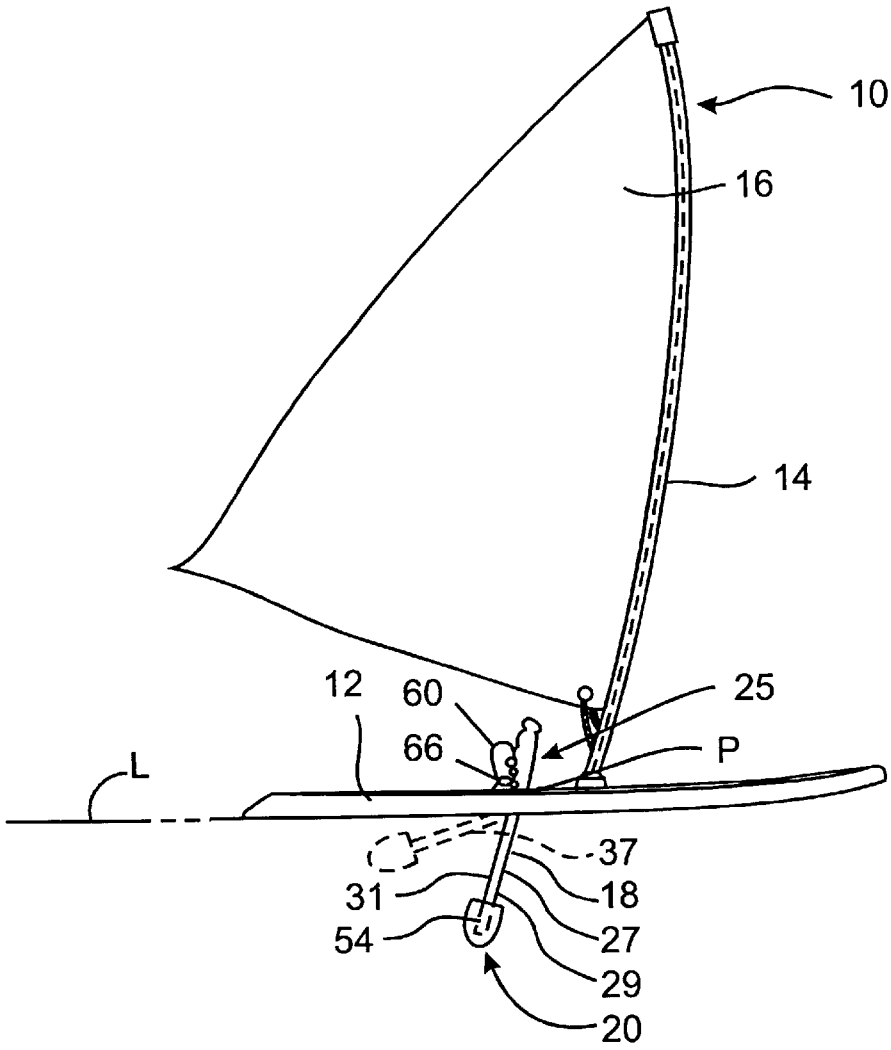
FIG. 1 is a perspective view of a wind surfing apparatus constructed in accordance with a preferred embodiment of the present.

Referring to FIG. 1, a wind surfer apparatus 10 constructed in accordance with a preferred embodiment of the present invention comprises a hull board 12, a mast 14, and a sail apparatus 16 of conventional construction and use. At least one removable daggerboard 18 extends downwardly through the hull 12 into the water and is uniquely formed with a weighted lower portion 20 to reduce rotational stability by resisting the tendency of the board to roll or tip about its longitudinal axis L. In this manner, novice sailors will be able to learn to do board sailing, and maneuvers by any sailor will be learned more easily with less effort.

Figure 3:
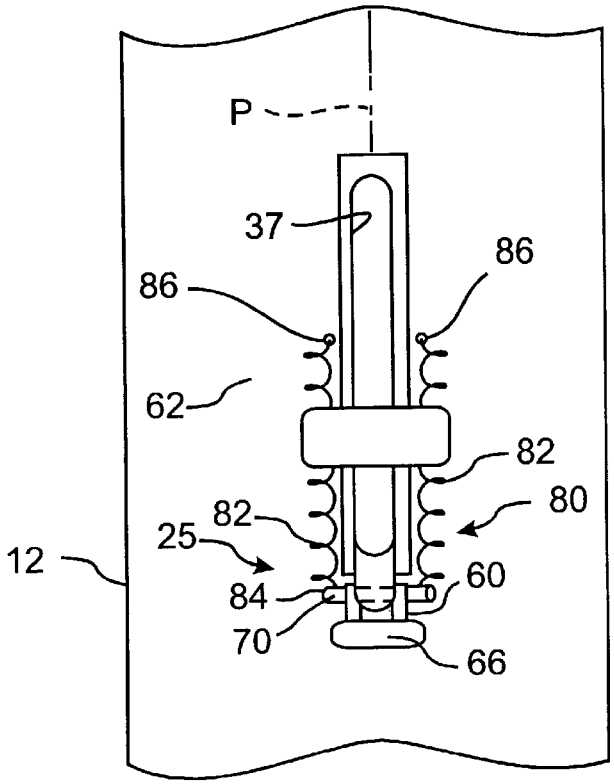
FIG. 3 is a top plan view illustration of the daggerboard and ratchet mechanism in accordance with the present invention.

In accordance with another feature of this invention, best depicted in FIGS. 1 and 3, the daggerboard 18 is constructed to be selectably positionable in terms of its orientation within a vertical plane P to the longitudinal axis L of the hull 12. This selectable orientation (see, e.g., the solid and phantom line positions in FIG. 1) is fixed by means of a uniquely designed ratchet assembly generally designated with reference numeral 25, that may be easily controlled by the sailor to either maintain the daggerboard 18 in a fixed orientation, or to change orientation, or to enable conventional use of the daggerboard by deactivating the ratchet mechanism. As will be seen more fully below, the ratchet mechanism assembly 25 may be used in combination with the weighted daggerboard portion 18,20 of the invention, or may be used to control the orientation of a conventional unweighted daggerboard.

When used with a weighted daggerboard, ratchet mechanism assembly 25 is preferably mounted aft (see FIG. 1) of the daggerboard for engagement with one or more teeth formed in an aft facing section of the daggerboard. The ratchet mechanism assembly 25 may be mounted forward of the daggerboard to engage forward facing teeth when the daggerboard is unweighted. Aft positioning of the ratchet 25 is desirable when used with a weighted daggerboard since the weight of the daggerboard will hold the ratchet in locked engagement with the daggerboard teeth. Aft positioning is also desirable since the sailor spends most of the time aft of the daggerboard. As will be discussed more fully below with reference to the FIG. 6 and 7 embodiments of the ratchet mechanism, it is possible to design the ratchet mechanism for use in either forward or aft positions.

Figure 1A:
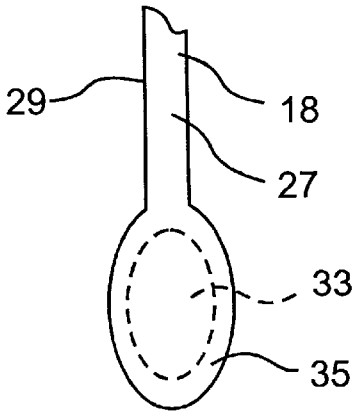
FIG. 1A is an enlarged view of a lower portion of a weighted daggerboard in accordance with a second embodiment of the invention.

The weighted daggerboard 18 is an elongate, hydrodynamically shaped member having opposing generally vertically extending wide faces 27 terminating in leading and trailing edges 29 and 31 which are suitably tapered in a known manner to stabilize the direction of movement of the hull board 12 with minimal drag. The wide faces 27 are oriented parallel to the direction of sailing movement are adapted to resist rotational instability and lateral movement inherently caused by the wind acting on the sail 16. In one alternate embodiment of the invention depicted in FIG. 1A, the ability to resist rotational instability is further imparted to the daggerboard 18 by molding a weighted mass 33 into the lower end thereof such as with an encapsulation material 35 that may be fiberglass, epoxy, or a combination thereof. The weighted mass is preferably selected to be in the range of 5–50 pounds and is molded so that the lower weighted end 33,35 of the daggerboard 18 has a hydrodynamic shape in the manner depicted in FIGS. 5 and 6. Preferably, the longitudinal and lateral dimensions of the encapsulated, weighted lower end 20, or 33,35, is less than the corresponding dimensions of the through slot 37 through which the end is initially inserted into the hull board 12 during placement of the daggerboard 18 into the hull.

To protect the daggerboard slot 37 from wear or abrasion due to the extra weight of the weighted daggerboard, it may be desirable to use an insert to line the slot walls and the pivot for the board, e.g., a metal lining insert shaped to conform to the slot walls and pivot sockets.

The feature of providing additional weight in the lower end of a removable daggerboard 18 imparts stability to the wind surfing apparatus 10 by providing ballast that resists the tendency of the board 12 to roll about its longitudinal axis L under improperly counterbalanced conditions caused by a combination of wind gusting and user inexperience in placement of weight on their feet or in the necessary stance. Molding of the weight 33 into the lower end by the daggerboard manufacturer ensures proper weight calibration for different boards and users of varying levels of experience. Encapsulation of the weight 33 into the daggerboard 18 itself also shields the weighted material from the hostile marine environment.

Figure 4:
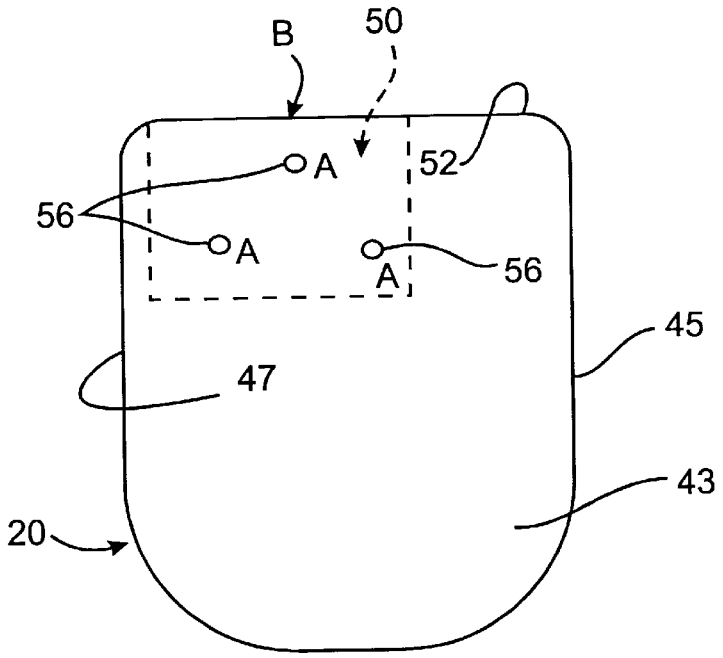
FIG. 4 is a side plan view of one of a series of preferably identical weights that may be removably secured to the lower end of the daggerboard.
Figure 5A:
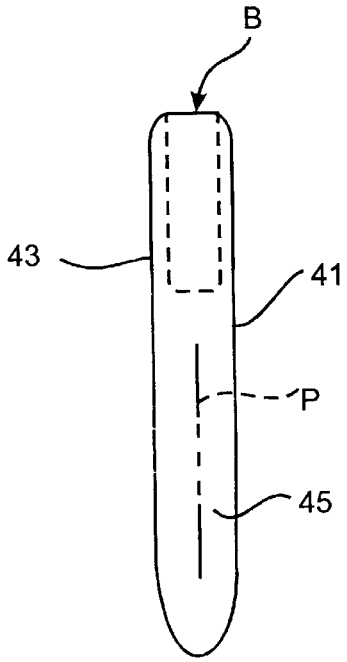
FIG. 5A is a rear end plan view of the weight of FIG. 4.
Figure 5:
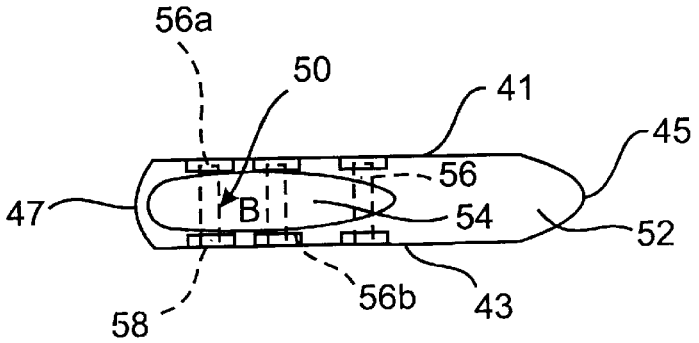
FIG. 5 is a top plan view of the weight of FIG. 4.

In accordance with a preferred embodiment of the invention, the weight 20 is preferably fixed to the lower end of the daggerboard 18 in a replaceable manner such as with screws, clamps and the like. With reference to FIGS. 4–6, the weight 20, preferably casted from lead, is formed with a pair of opposing wide faces 41 and 43 and leading and trailing tapered edges 45 and 47 that are preferably hydrodynamically shaped to avoid interference with the hydrodynamic characteristics of the daggerboard 18 projecting upwardly therefrom in an otherwise conventional manner. An upwardly directed mounting cavity 50 is uniquely formed in the top edge 52 of the weight 20 and has a cross sectional area in top plan view (FIG. 5) corresponding to the cross-section of the lower end 54 of the daggerboard 18 for snug fitting insertion therein. The daggerboard lower end 54 is preferably retained in the mounting cavity 50 by means of three or four screws 56 passing through the cavity side walls 58 and the daggerboard lower end to ensure positive locking retention of the weight 20 to the daggerboard 18. Preferably, the screws 56 are flathead bolts 56*a* received in a countersunk opening in one face 41 with a nut 56*b* received in another countersunk in the opposing face 43 to avoid projecting from the faces.

The feature of attaching the weight 20 to the daggerboard lower end 54 in the manner of the invention advantageously enables selection by the sailor of a desired amount of weight, typically between 5–50 pounds. Accordingly, it is contemplated that the daggerboard 18 of the invention may be sold in a kit form consisting of a daggerboard and at least one weight 20 formed with a mounting cavity 50 adapted to receive the daggerboard lower end 54 as described above, and, optionally also a package of screws 56 or other types of fastening means for securing or clamping the lower end within the cavity.

Figure 2:
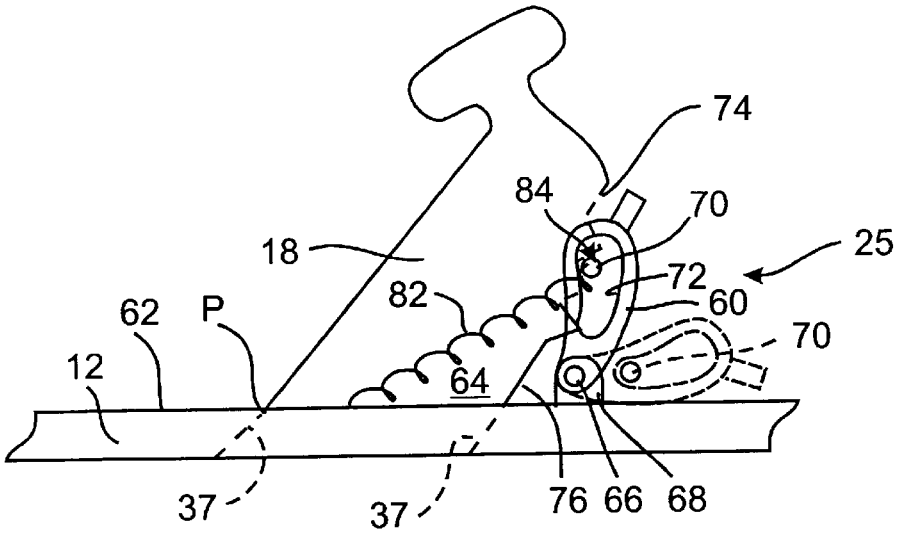
FIG. 2 is an enlarged partial elevational view of one embodiment of the ratchet mechanism depicted in FIG. 1 for selecting and maintaining a predetermined orientation between the daggerboard and hull board.

Depending upon the skill level of the wind surfer, as well as wind and beach conditions, it is often desirable to pivot the daggerboard 18 relative to the hull longitudinal axis L about a transverse pivot axis P to control the extent to which the daggerboard 18 projects into the water and to vary hydrodynamic performance of the wind surfer. In the past, a wind surfing sailor would typically use their feet to pivot the conventional un-weighted daggerboard into a desired orientation and maintain the daggerboard in a particular position based upon experience and feel. However, the weighted lower end 20 of the daggerboard 18 according to the present invention tends to bias the daggerboard into its lowermost position (solid line position of FIG. 1), particularly at lower speeds, interfering with the sailor's ability to adjust the daggerboard to different settings. If it is desired to overcome this fixed orientation, the ratchet mechanism 25 or another type of locking assembly is used to control the orientation of the retractable and selectably movable daggerboard assembly. As best depicted in FIGS. 2 and 3, the ratchet assembly 25 is comprised of a pair of parallel ratchet arms 60 pivotally mounted to the top surface 62 of the hull 12 at a location spaced forwardly of the upper end 64 of the daggerboard 18 projecting above the hull top surface from the vertical through slot 37. More specifically, a transversely extending pin or shaft 66 passes through the lower ends of the ratchet arms 60 for connection to the hull 12 through a pair of mounting ears 68. A transversely extending ratchet pawl 70, preferably rod-shaped, extends between the ratchet arms 60 and has opposite ends thereof received respectively in an elongate mounting slot 72 formed in the distal end of each arm.

The ratchet pawl 70 extends perpendicular to the hull longitudinal axis L and is pivotable in a forward (clockwise) direction into engagement with one of a plurality of ratchet recesses or protrusions 74 arranged in an arc along a rearward facing edge 76 of the upper handle portion 64 of the daggerboard 18 projecting upwardly from the daggerboard mounting slot 37. Pivotal movement of the ratchet mechanism 25 may be controlled by the sailor's hands or feet to ensure ratcheted engagement with a selected one of the protrusions 74. Since each ratchet protrusion 74 preferably moves in an arcuate path having the daggerboard pivot shaft P as its center of rotation, the feature of supporting the opposite ends of the ratchet pawl 70 in an elongate slot 72 extending radially relative to the ratchet arm pivot axis 66 advantageously assures reliable engagement of the ratchet pawl with any one of ratcheted protrusions.

A biasing assembly 80, preferably in the form of a pair of tension springs 82, applies a biasing force to normally bias the ratchet pawl 70 in the direction of the ratcheted protrusions 74 to ensure reliable predetermined orientational positioning of the daggerboard 18. In the first embodiment, the rearward end 84 of each tension spring 82 is secured to an associated one of the opposite ends of the ratchet pawl 70. The springs 82 extend parallel to each other on either side of the daggerboard mounting slot 37 for pinned connection to the top surface 62 of the hull 12 with a pin or screw 86.

In accordance with a further feature of this invention, the ratchet mechanism 25 is pivotable into an aft (if the mechanism is installed aft of the daggerboard) disengaged position out of contact with the ratcheted protrusions 74 where it lies flat against the hull top surface 12 as depicted in phantom line in FIG. 2. By locating the ratchet arm pivot axis 66 to be elevationally higher than the radially inwardmost position of the ratchet pawl 70, the spring force of the tensioning assembly 80 can be further used to positively bias the ratchet mechanism 25 in the forwardmost neutral position. In this manner, the daggerboard 18 can be easily mounted and dis-mounted from the hull 12 and used in a conventional manner.

Figure 6A:
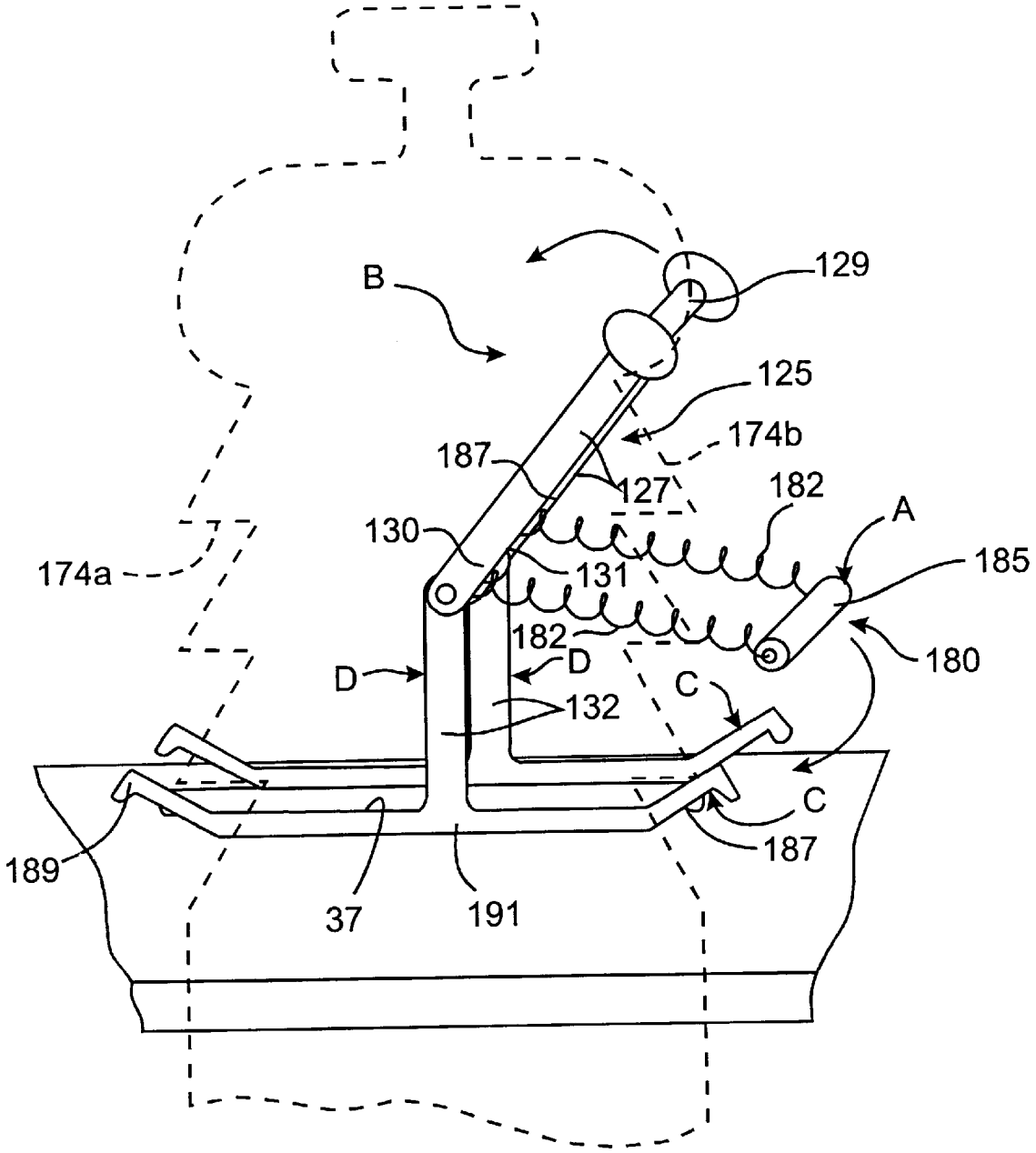
FIG. 6A is a side elevational view, partly in perspective, of a second embodiment of a ratchet mechanism for use in the present invention.

In FIGS. 6A–6E, there is disclosed a second embodiment of a ratchet mechanism, that is formed with a pair of generally parallel handle arms 127 supporting a handle 129 extending transversely between distal ends thereof. Corresponding proximal ends 130 of the handle arms 127 are pivotally connected at 131 to respective upper ends of a pair of center posts 132 that project upward from opposing longitudinal sides of the daggerboard mounting slot 37 as best depicted in FIG. 6A. The handle assembly 125 is advantageously suited for use with either a weighted or unweighted daggerboard since the handle arms 127 are of a sufficient length to tension a ratchet pawl 185 to engage either forward facing ratchet recesses or protrusions 174*a* (e.g., for use with an unweighted daggerboard), or for engagement with plural aft facing ratchet recesses or protrusions 174*b* for use with a weighted daggerboard.

Figure 6B:
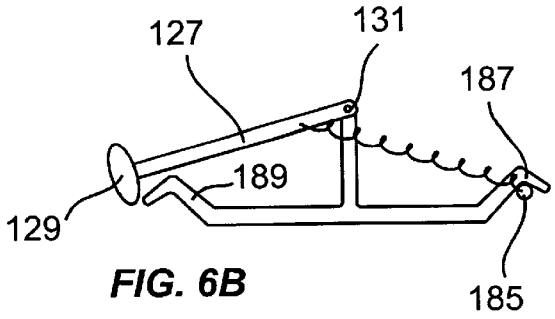
FIGS. 6B–6E are side views, partly schematic, depicting the ratchet mechanism of FIG. 6A in selective use in either forward or aft positions.
Figure 6C:
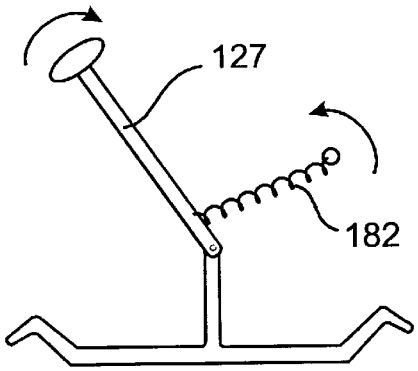
Figure 6D:
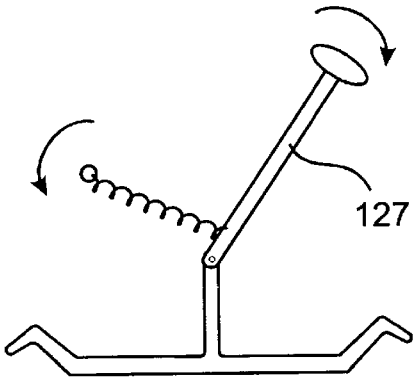
Figure 6E:
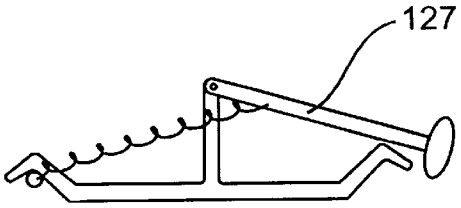

A biased ratchet assembly 180, preferably in the form of a pair of tension springs 182, applies a biasing force to normally bias the ratchet pawl 185 in the direction of the ratcheted protrusions 174*a* or 174*b* to ensure reliable predetermined orientational positioning of the daggerboard. In this second embodiment, the ratchet pawl 185 is respectively connected at opposite ends thereof to common ends of the springs 182 while the other ends of the springs are respectively connected to intermediate portions 187 of the handle arms. With this construction, the pawl 185 can be positioned beneath one of two pairs of rearward or forward restraining horns 187 or 189 to engage one of ratchet teeth 174*a* or 174*b* located beneath the horns, under spring bias achieved by rotation of handle 125 in the opposite direction. For example, FIG. 6B is an illustration of the ratchet assembly 180 pivoted into an operating position to engage the aft teeth on the weighted daggerboard (not shown for ease of illustration). With this unique arrangement, the ratchet pawl 185 may alternatively be used with an unweighted daggerboard to hold it down against the force of the water, simply by removing the ratchet 185 from beneath the aft restraining horns 187 (from the FIG. 6B position), followed by pivoting of the ratchet assembly 180 from the aft to the forward direction (counterclockwise in FIGS. 6C and 6D) while the handle arms 127 and handle 129 are pivoted as a unit from the forward to the aft position in the clockwise direction of FIGS. 6C and 6D. In FIG. 6E, the ratchet mechanism 125 is depicted in an engaged position for use with an unweighted board. Thereby, the ratchet mechanism 180 of the second embodiment can easily be pivoted into operative positions for use with either a weighted or unweighted daggerboard.

In the FIG. 6 embodiment, one rearward and one forward restraining horn 187,189 of each pair may be integrally formed at opposite ends of a longitudinally extending connecting member 191 that can be screwed or otherwise attached to the top surface of the hull adjacent a common edge of the daggerboard mounting slot 37. One of the two mounting posts 132 may extend upward from an intermediate portion of the longitudinal connecting member 191 and can be integrally formed therewith such as in the form of a plastic or metal casting. In this manner, two of such constructions are respectively and easily attached to the hull top surface adjacent each side of the mounting slot 37. The handle arms 127 and handle 129 can then be easily connected to the center posts 132 such as with releasably attachable pinned connections as will now occur to those skilled in the art.

In the alternative, the springs 182 can be secured at positions adjacent the slot and sized to provide tension to secure pawl 185 engaged beneath either set of horns 187,189 without handle assembly 125. This would have the advantage of being a less complicated mechanism with the possible disadvantage of being more difficult to use while underway.

In lieu of the biasing assembly 80 or 180 described hereinabove, it may be possible to simply utilize a length of resilient shock cord attached and operating in the same manner as springs 182 and pawl 185, i.e., the shock cord also functions as the pawl at one end thereof to one or both ratchet arms 127. The opposite end of the cord may support a tab (not shown) that can be engageable with one or both restraining horns. Other configurations are possible, some of which are discussed further below.

Figure 7A:
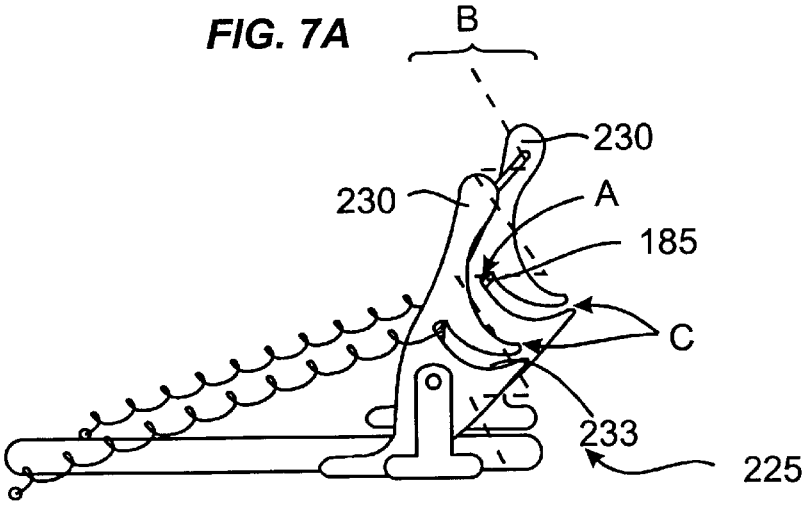
FIG. 7A is a perspective view of a third embodiment of a ratchet mechanism in accordance with the present invention.
Figure 7B:
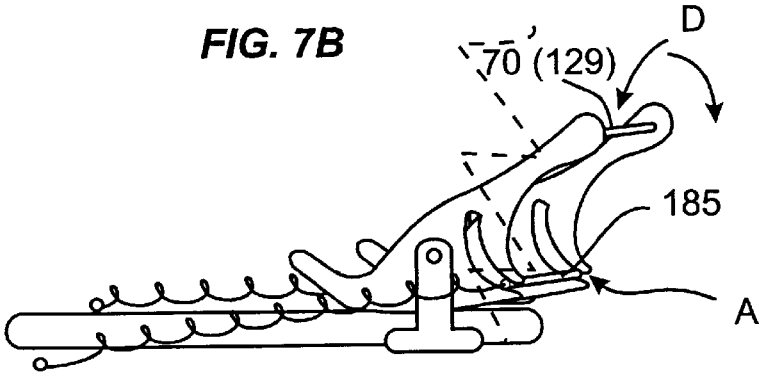
FIG. 7B is a view similar to FIG. 7A with the ratchet in disengaged position.
Figure 7C:
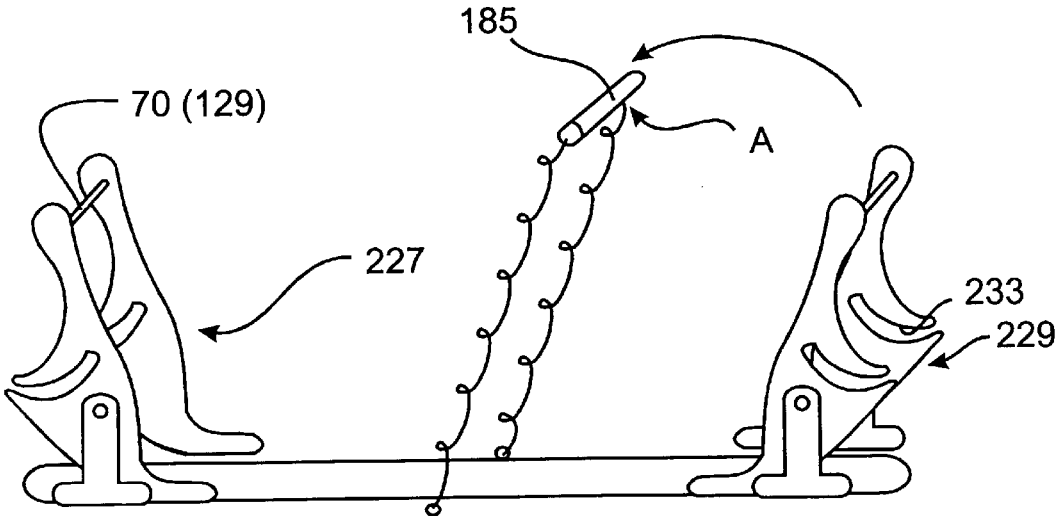
FIG. 7C is a perspective view of the ratchet mechanism being moved into operative position for forward engagement with a daggerboard.

The ratchet assembly 180 may also be used in combination with a third embodiment of a handle mechanism 225 depicted in FIGS. 7A–7C. Therein, two pairs of identical forward and rearward handle arms 227 and 229 are pivotally mounted at forward and rearward ends of the mounting slot 37. The handle 70 or 129 extends transversely between laterally spaced handle arm portions 230 to enable engagement of the ratchet pawl 185 with associated forward or rearward facing ratchet teeth 174*a*,174*b* formed in the daggerboard. Each of the handle assembly pairs 227,229 is further formed with an open slot 233 at intermediate portions thereof which open in either the forward or rearward direction as best depicted in FIG. 7C. The ratchet pawl 185 easily slips into corresponding ones of the forward or rearward slots 233 to either bias the ratchet mechanism into the engaged (FIG. 7A) or disengaged position (see FIG. 7B).

Figure 8:
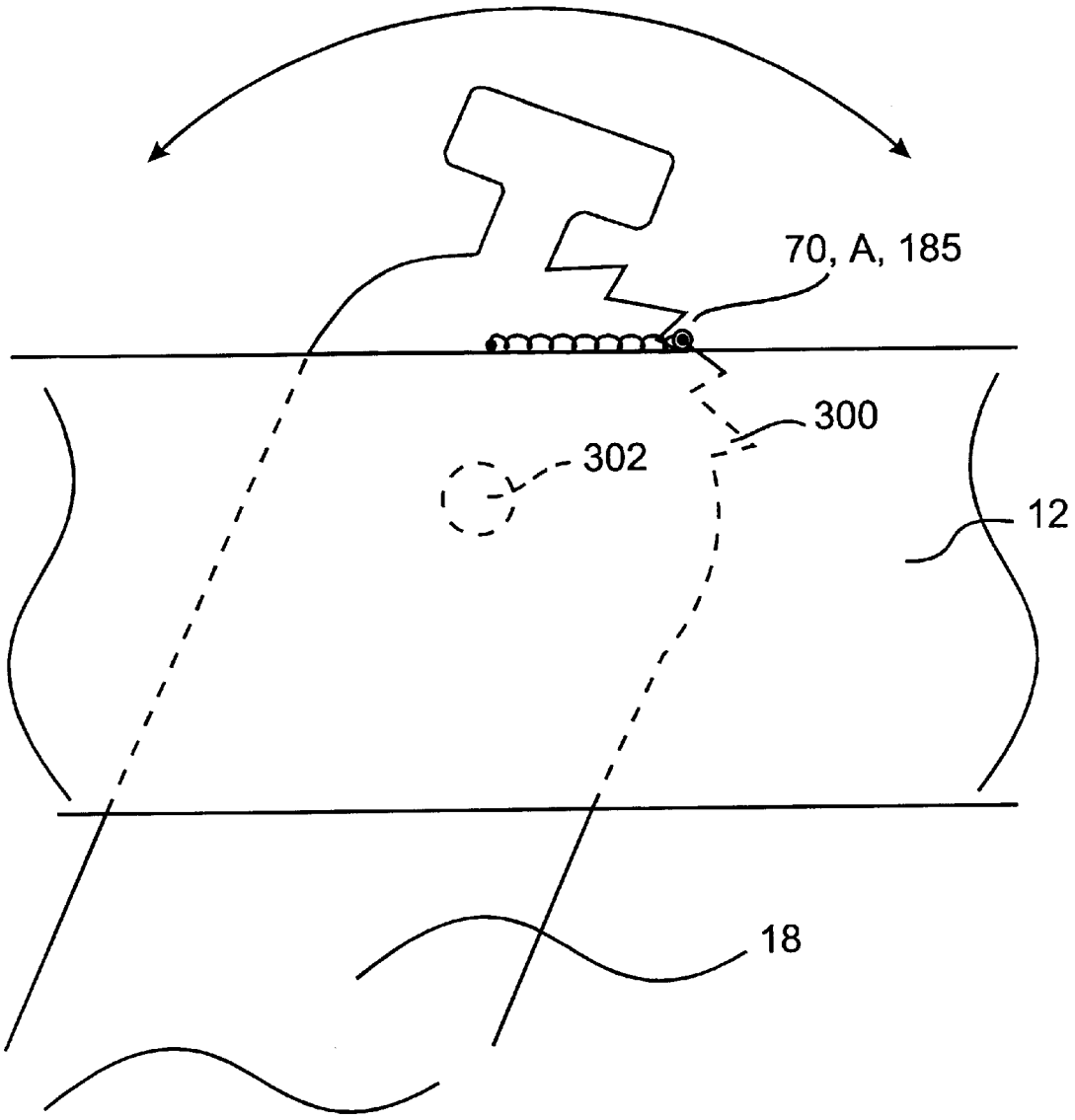
FIG. 8 is an enlarged side view of an alternate design of ratchet teeth provided on the daggerboard.

FIG. 8 is an illustration of an alternative arrangement of ratchet teeth 300 (shown on only one side of the board for ease of illustration) arrangement along an arc having a radius of curvature defined by the pivot point 302 of the daggerboard to accurately engage the ratchet pawl 70 or 185.

It is also possible, in lieu of providing a weighted daggerboard, to instead locate the weight in the lower part of the hull or as an attachment of a weighted mass to the hull bottom. Weight location in this manner would preferably be used in conjunction with an unweighted daggerboard in combination with one of the ratcheting mechanisms or equivalent thereof disclosed hereinabove. This type of weight placement has the advantage of not wearing out the hull board or the mounting slot 37 prematurely although it does not provide the same degree of leverage as would placement of weight at or near the bottom of the daggerboard.

It is also within the scope of this invention to add weight to the daggerboard by forming a cavity in the lower end of the daggerboard and disposing a weighted mass more or less entirely into the cavity for retention therein with one or more screws extending through one or more cavity side walls and the weight.

It will now be obvious to one of ordinary skill in the art from a review of this specification that other means may be provided to control the orientation of the daggerboard. Additionally, it can be further appreciated that the ratchet mechanism of the invention may also be used in conjunction with conventional or un-weighted daggerboards to counter the normal tendency of the lifting force of the water against the leading edge of the submerged portion of the daggerboard which causes the submerged portion to pivot rearwardly and upwardly at certain speeds irrespective of weight. In the case of unweighted daggerboards, the ratchet mechanism is preferably installed forward of the daggerboard in order to resist the tendency of the board to rise in the manner described above. The FIG. 6 and 7 embodiments of the ratchet assembly are uniquely suited for use in either forward or rearward locations to provide a universal type of ratchet mechanism for use with either weighted or unweighted daggerboards.

A weighted daggerboard constructed in accordance with the invention could also be used in any small sailing craft that utilizes a daggerboard.

Figure 9:
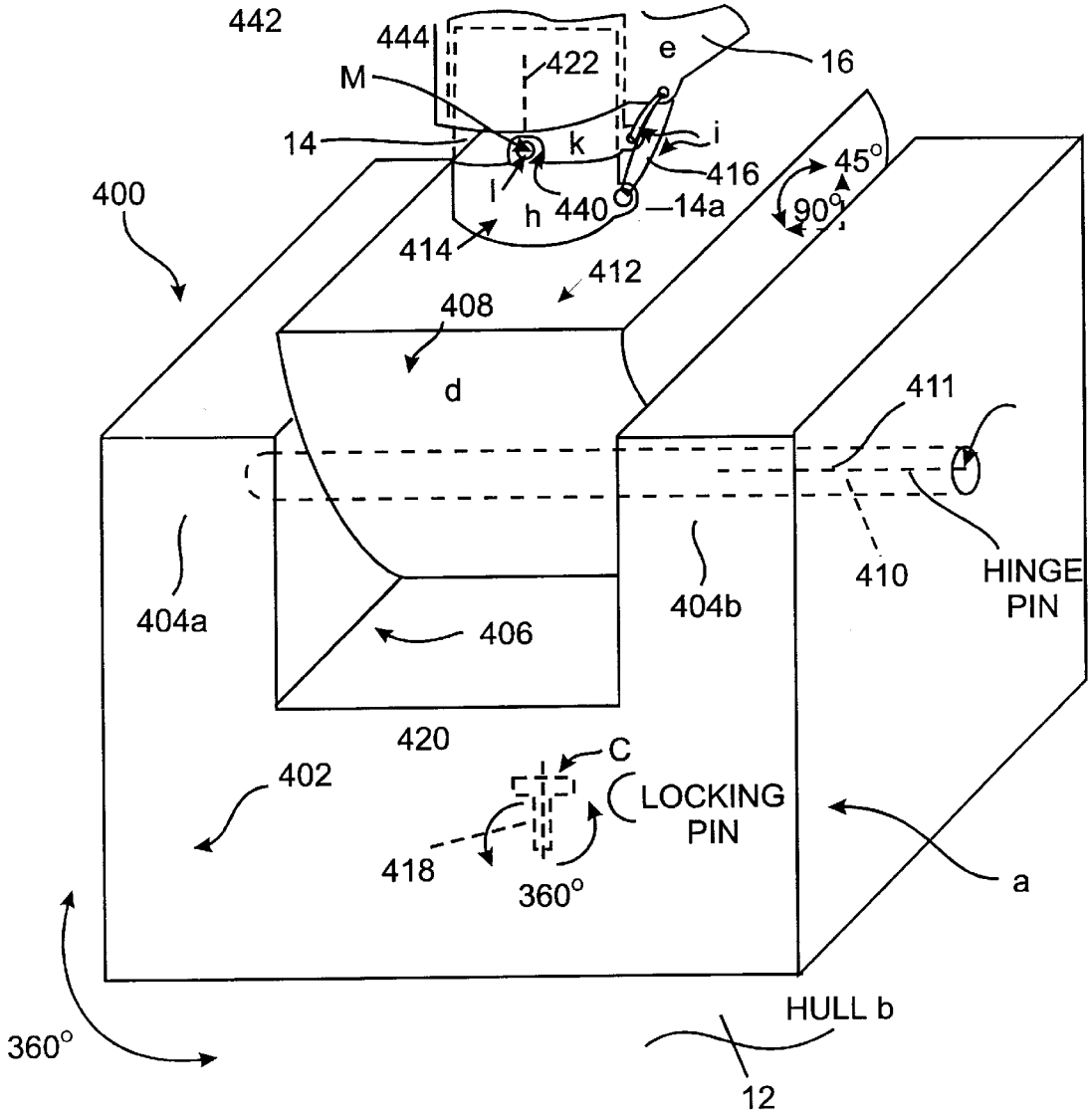
FIG. 9 is an enlarged perspective view of a novel hinge that may be used in place of a conventional universal joint to attach the sail mast to the hull.

FIG. 9 is a perspective view illustration of a unique hinge 400 for attaching the mast 14 to the hull 12. The hinge 400 is formed with a hinge block 402 having a pair of parallel upstanding hinge arms or leaves 404*a* and 404*b* that define a channel 406 receiving a semi-cylindrical hinge leaf 408 interconnected to the hinge arms with a hinge pin 410 extending therethrough. The hinge pin 410 defines a rotational axis 411 that is preferably parallel to the hull upper surface 62. Hinge leaf 408 and mast 14 secured thereto pivot about axis 411 under the sailor's control.

The preferably upper flat surface 412 of the hinge leaf 408 supports a cylindrical anchoring projection 414 extending upward therefrom for reception in the lower open end of the mast 14 to which the sail 16 is attached. The sail 16 may be connected to the anchoring projection 414 by means of a flexible tie 416 preventing dislodgement of the sail and mast from the hinge 400.

The hinge block 402 is secured to the hull 12 by means of a locking pin 418 or other type of arrangement preventing separation of the hinge from the hull upper surface 62 while permitting the hinge to be rotatable through 360° about a rotational axis 420 extending perpendicular to the hull upper surface. The rotational axis 420 is preferably coaxial with the longitudinal axis 422 of the mast 14. In this manner, the unique hinge 400 enables the user to pivot the sail 16 through 360° about the vertical axis 420 perpendicular to the hull (i.e., within a horizontal plane) while the interaction between the hinge leaf 408 and hinge arms 404*a,* 404*b* restricts the vertical movement of the mast and sail to movement in the plane of the sail, i.e., without moving in a direction perpendicular to the plane of the sail, as occurs with conventional flexible universal joints commonly used to attach a windsurfer mast to the hull.

The unique hinge 400 of the invention is preferably used with the weighted daggerboard 18, 20 disclosed in the embodiments herein with sufficient weight in the daggerboard to prevent the hull 12 from capsizing with the sail 16 partly up in a neutral position ("luffing") in average wind conditions. In the absence of the weighted daggerboard, it is believed that the weight of the mast 14 and sail 16 held partly up out of the water would cause the hull 12 to capsize.

The hinge 400 of the invention decreases the force necessary for the sailor to exert in getting the sail up into operative position since the sail 16 is partly held up in position by the force of the hinge. The hinge 400 thus simplifies the process of getting the sail 16 up and set in sailing, since the motion and force transmission of the sail will advantageously be in only one plane (the plane of the sail) and not in infinite planes as occurs with a conventional flexible universal joint. Hinge 400 of the invention will provide more options in sailing stance and position of the operator since much of the force needed to keep the sail 16 upright against the wind will be provided by the hinge. Thus, hinge 400 will act as a quick learning device for novices, provide ease of maneuvering for intermediate sailors, and generally make possible easier tacking into the wind. Use of hinge 400 plus the weighted daggerboard may also result in a new type of straight downward surf sailing by decreasing the difficulty of controlling the sail/mast unit 14, 16 and balancing the hull 12.

As mentioned above, the unique hinge 400 of the invention enables the sail and mast combination 14, 16 to rotate horizontally around the axis 422 of the mast through the locking pin arrangement while the hinge itself permits the sailing mast to move back and forth in the plane of the sail. It is possible to limit the back and forth degree of movement to, for example, 45° from the horizontal so that the mast 16 would always remain partially up out of the water. It will be appreciated that the movement may be so limited by means of stops (not shown but the structure and placement of which would be obvious to persons skilled in the art upon review of this disclosure) placed between the hinge arms 404*a,* 404*b* and hinge leaf 408.

Figure 10:
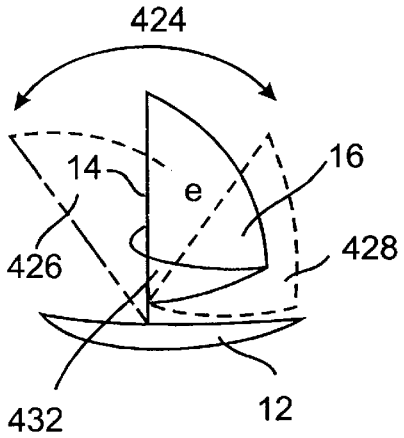
FIG. 10 is a side elevational view of a wind surfer utilizing the hinge of FIG. 9 with the sail positioned fore and aft with respect to the hull.
Figure 11:
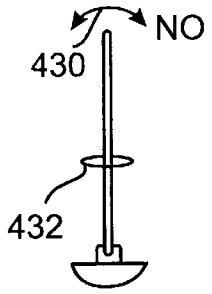
FIG. 11 is a front elevation view of the wind surfing apparatus of FIG. 10.
Figure 12:
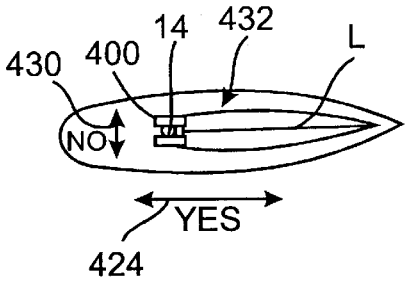
FIG. 12 is a top plan view of the wind surfing apparatus of FIG. 10.
Figure 13:
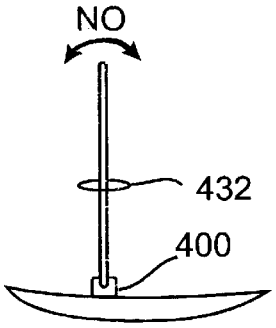
FIG. 13 is a side elevational view similar to FIG. 10 with the sail pivoted 90° from the FIG. 10 position so as to be perpendicular to the hull.
Figure 14:
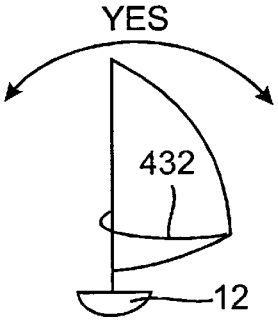
FIG. 14 is a front elevation view of the wind surfing apparatus depicted in FIG. 13.

FIGS. 10–15 illustrate various types of sail movement achieved with hinge 400. In FIG. 10, arrow 424 indicates the permissible movement within the plane of the sail 16 in fore and aft directions, 426, 428, respectively. From FIGS. 11, 12, it can be seen that the hinge 400 is operable to prevent movement in the direction of arrow 430, i.e., perpendicular to the plane of the sail. In FIG. 13, the sail 16 is rotated through infinitely variable amounts about the locking pin 418 into positions such that the plane of the sail is perpendicular to the longitudinal axis L of the hull 12. In this position (see especially FIG. 15) the mast 14 and mast 16 are prevented from moving fore and aft but can move from side to side.

Figure 15:
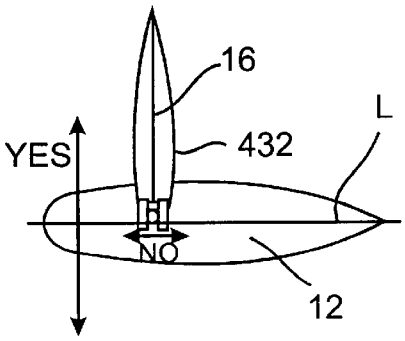
FIG. 15 is a top plan view of the wind surfing apparatus depicted in FIG. 13.

The sail positions depicted in FIGS. 10 and 15 correspond generally to the sail orientation for tacking into the wind, or running down wind. The sailor controls the direction by moving the sail 16 aft and parallel to the hull to tack (see phantom line position 428 in FIG. 10), or can move the sail forward and perpendicular to the hull 12 to fall off the wind.

The neutral position is depicted in FIGS. 10–12 with the mast 14 tilted back 45° to the water (position 428) and with the sail 16 luffing, to enable a novice to climb on and stand on top of the hull 12 (from the opposite side of the sail 16), pull the mast up the rest of the way (e.g., to the FIG. 14 position) and then pull on conventional wishbone boom 432 to bring the sail against the wind (sheet in) to start sailing. This process, which is the central first step in wind surfing, is made much easier with the hinge 400 of the invention.

In addition, for down wind sailing, it is possible for the sailor to tip the mast forward to a limit, for example, of 45° (see position 426 in FIG. 10). The sailor could then move aft along hull 12 if planing were achieved while controlling the attitude of the sail 16 with appropriate extensions (e.g. a rigid or flexible wishbone boom control attachment that will allow the sailor to vary their position relative to the wishbone boom 432).

The novel hinge 400 of the invention enables other improvements to now be realized. For example, in one further improvement, a wishbone-to-mast joint that is locked (e.g., with a pin or a locking jaw) to hold the sail 16 in a fixed rotational relationship to the mast may be provided.

As shown above, the plane of the sail is held perpendicular to the hinge axis 411. In order to allow the sail to lie flat in the water, it is necessary to free this restriction. To enable the unit formed by the sail 16 and mast 14 to rotate freely about the hinge axis 411 and the pin axis 420, the mast 14 is formed with a short vertical slot 440 communicating with the bottom edge thereof which is adapted to receive a positioning pin 444 extending outwardly from the mast support projection 414. When the pin 444 is engaged with the slot 440 as shown in FIG. 9, the movement of the mast 14 and sail 16 is restricted by the hinge 400 within the plane of the sail. However, if the mast 14 is lifted upwardly to disengage the pin 444 from the slot 440, the bottom edge 14*a* of the mast will essentially ride on the pin to enable the mast to rotate about its axis 422 until the peg re-engages the slot. Once engaged the mast 14 sail 16 would be held there by weight, plus possibly by an internal or external spring or elastic mechanism.

The hinge 400 of the invention is preferably covered with a rubber skin to protect the operator's feet.

In summary as to hinge 400 the sail-hull orientation necessary to move a wind surfer efficiently on all points (tacking, reaching and running) can be resolved into a 360° rotation of the mast\sail unit about the mast\sail axis 422, and tilting from 45° back to 45° forward of the vertical in the single vertical plane defined by the sail 16. These orientations are advantageously achieved with the hinge 400 of the invention as noted hereinabove.

Figure 16:
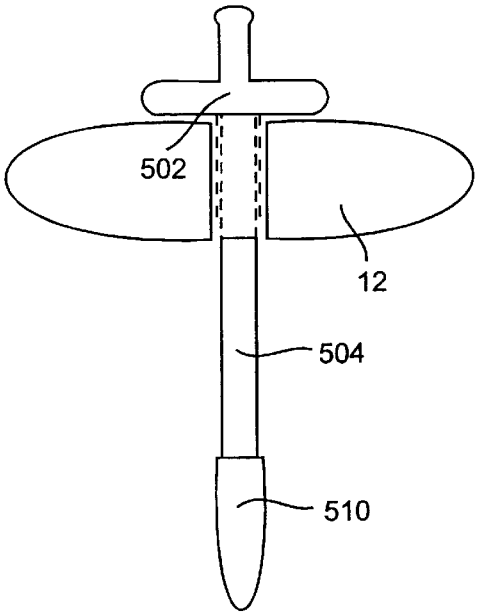
FIG. 16 is a further embodiment of a universal mount locating the weighted daggerboard in operative position within the hull.

Reference is now made to FIGS. 16–22 depicting a weighted daggerboard of the invention with a universal mount 500. In FIG. 16, the upper end of the daggerboard 504 is formed with a pair of transversely extending cylindrical projections 402 oriented perpendicular to the slot 37 to engage and rest on the hull upper surface 62 and allow the daggerboard to sit within the slot. These projections 502 enable the daggerboard to be used with a variety of hulls of different manufacturers.

Figure 17:
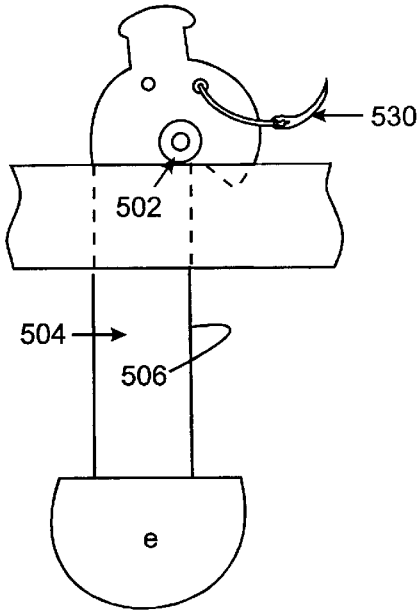
FIG. 17 is a side elevational view of the front view depicted in FIG. 16.

In FIG. 17, it can be seen that the projections 502 are positioned in vertical alignment with the rear edge 506 of the daggerboard 504 so that the daggerboard can tip up slightly aft in order to easily ride over an obstruction.

Figure 18:
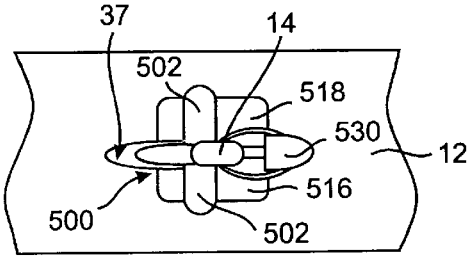
FIG. 18 is a top plan view of the embodiment depicted in FIGS. 16 and 17.
Figure 19:
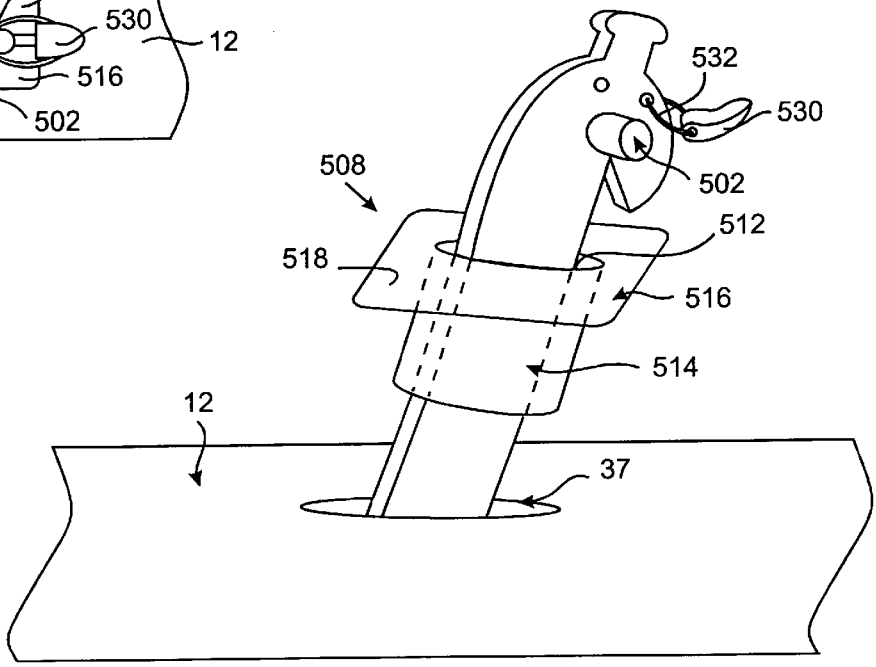
FIG. 19 is a perspective view of the FIG. 16 embodiment with the weighted daggerboard partially withdrawn from the slot.

To facilitate use in various hulls of different manufacturers, a series of shims 508 may be provided to be placed on the daggerboard as best shown in FIG. 19. The weight 510 may be unbolted from the bottom end of the daggerboard 504, the shim 508 placed on the daggerboard by insertion first of the daggerboard lower end through the shim opening 512, with the weight then reattached. Alternatively, the shim 508 may be of split configuration (not shown) and sufficiently flexible to be bent open for placement around the daggerboard 504 before springing into a closed position. The shims 508 would be constructed with an exterior shape or sleeve 514 sized to fit snugly into the daggerboard slot 37 to prevent small scale oscillation of the hull 12 around the daggerboard, and an upper flange 516 providing an upper surface 518 on which the support projections 502 would rest as depicted in FIG. 18. The flange upper surface 518 is sufficiently wide and rigid to cover the slot 37 and support the weight of the daggerboard. To absorb resulting oscillations and wear, the shim 508 preferably is a resilient material such as rubber or plastic.

The universal mount 500 described hereinabove greatly improves portability to enable use of the same daggerboard from one type of hull to another.

Figure 20:
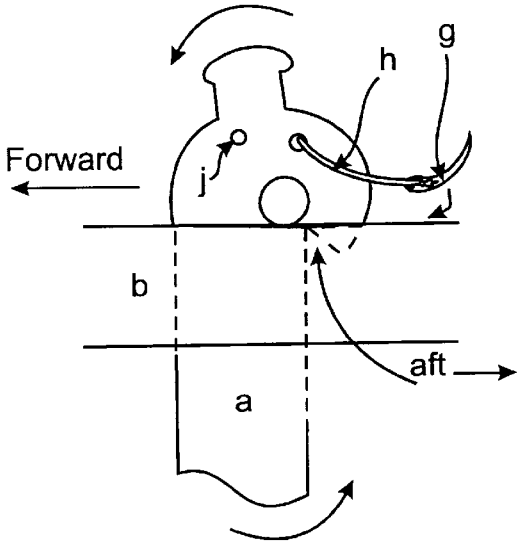
FIG. 20 is a partial side elevation prior to rotating the bottom of the daggerboard to an aft position.
Figure 21:
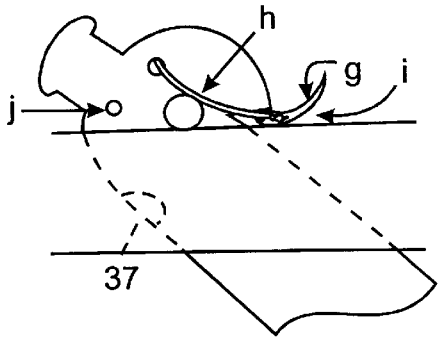
FIG. 21 is a view similar to FIG. 20 with the bottom of the daggerboard rotated to the aft position.
Figure 22:
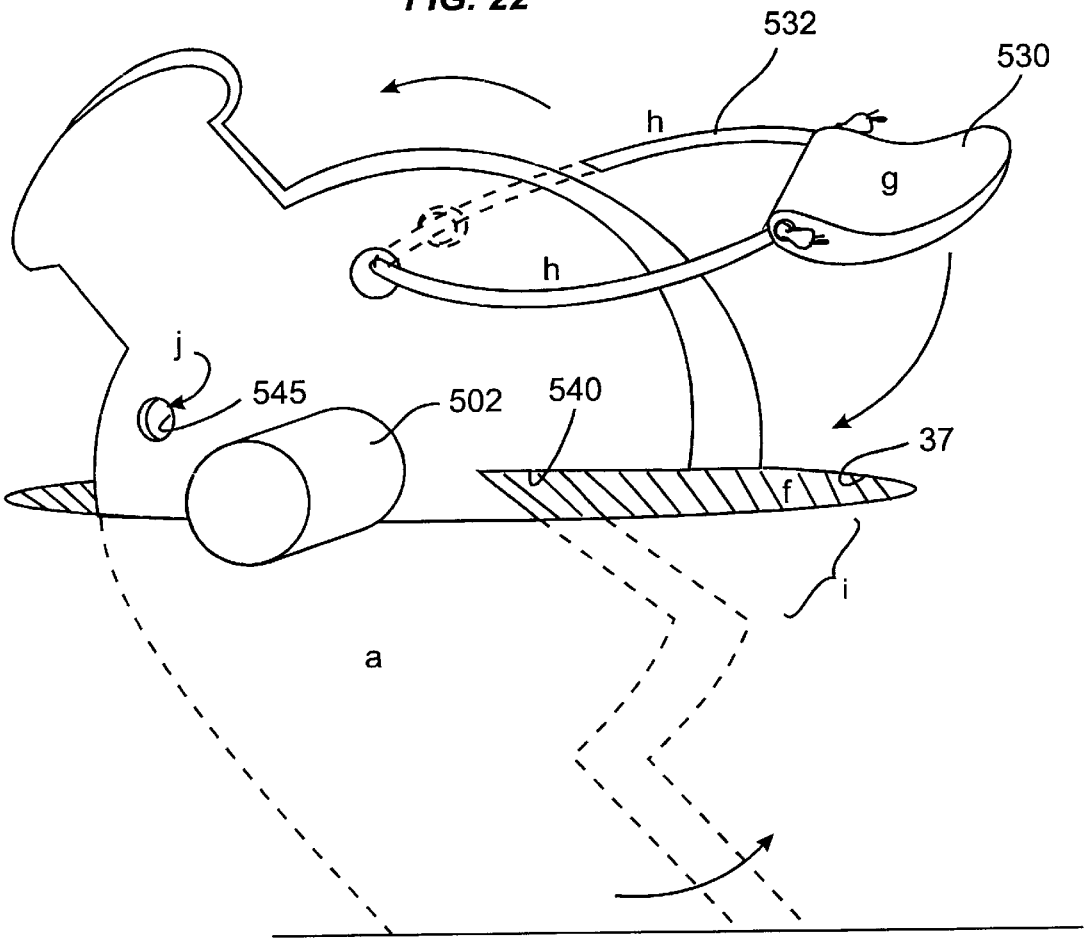
FIG. 22 is a perspective view of the daggerboard when rotated into the aft position of FIG. 21.

In place of the ratchet teeth arrangement in the embodiments described above, the daggerboard may be provided with a rigid tab 530 connected by a loop of shock cord 532 to a hole in the daggerboard upper end. The top of the daggerboard is tipped forward as depicted in FIG. 22 to enable tab 530 to be pulled down until it enters the slot 540 in the daggerboard upper end. Tab 530 then engages into the slot 540 and is held in place by the springiness of the shock cord 532 to prevent the weighted bottom of the daggerboard from rotating back down. In this manner, the daggerboard may be tipped into an inclined position as depicted in FIG. 21 to decrease the draft of the rig, for example, when going on and off a beach. The tab is easily pulled out of the slot 540 to enable the free daggerboard to rotate back down to vertical (FIG. 20).

A hole 545 may be provided in the daggerboard for attachment of a line (not shown) loosely secured to the mast 16. This prevents loss of the daggerboard and easy retrieval in the event it slips into the water through slot 37.

Figures 23, 24:
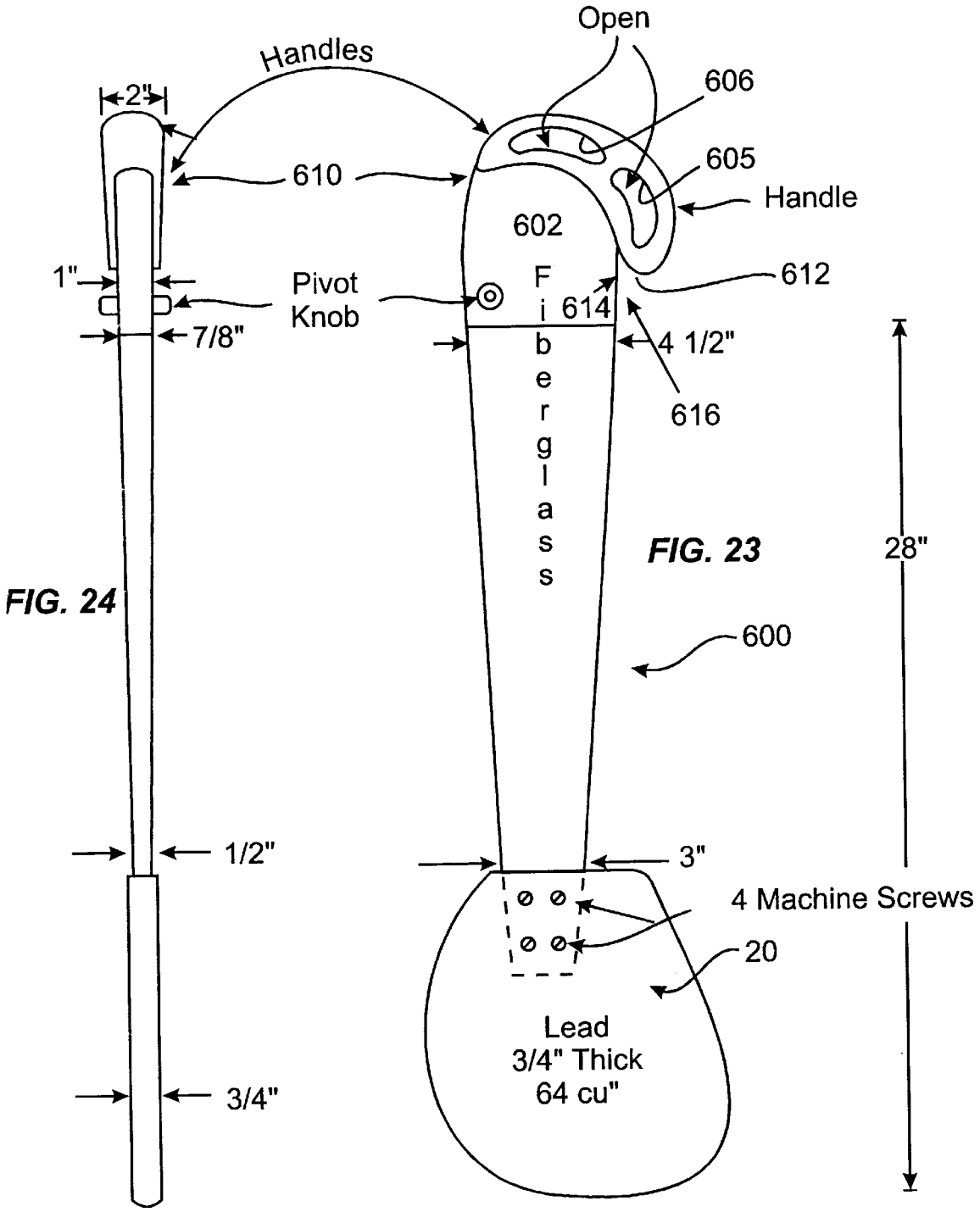
FIGS. 23 and 24 are side and front elevational views, respectively, of a weighted daggerboard.

FIGS. 23 and 24 are side and front elevational views, respectively, of a novel weighted daggerboard 600 which is similar to daggerboard 18 and weight 20 described above with reference to FIGS. 1–6, inclusive of pivot projections 602, though formed with a unique molded handle 610 in an upper end thereof provided with openings 606, 608 that facilitate either carrying of the daggerboard or ease of manipulation with the sailor's foot engaging one of the openings to pivot the board. This molded upper end 610 is formed with an [inset] straight edge 612 intersecting the aft facing edge 614 of the daggerboard at an acute angle to form a notch or slot 616. This slot 616 is functionally similar to slot 540 in the FIG. 20 embodiment and may cooperate with a tab 530 attached with a shock cord 532 to the daggerboard upper end 610 to enable the daggerboard to be rotated and fixed into an inclined position such as shown and described above. The weight 20 may be fixed to the daggerboard lower end with screws in the manner described above.

It will be readily seen by one of ordinary skill in the art that the present invention fulfills all of the objects set forth above. After reading the foregoing specification, one of ordinary skill will be able to effect various changes, -substitutions of equivalents and various other aspects of the invention as broadly disclosed herein. It is therefore intended that the protection granted hereon be limited only by the definition contained in the appended claims and equivalents thereof.

What is claimed is:

1. A sailing craft comprising:

a hull;

a mast and sail mounted to project upward from the hull during sailing;

a daggerboard removably mounted to project downward from the hull into the water during sailing; and a hinge connecting the mast to the hull, said hinge including a first connection enabling movement of the mast and hull about the first connection only in the plane of the sail, and a second connection, separate from the first connection, connecting the hinge to the hull to permit rotation of the hinge about an axis extending upwardly from and perpendicular to the hull.

2. The sailing craft of claim 1, further comprising a weight attached to the daggerboard to lessen the tendency of the sailing craft to be unstable or flip during use.

3. A sailing craft comprising:

(a) a hull;

(b) a mast and sail mounted to project upward from the hull during sailing;

(c) a daggerboard removably mounted to project downward from the hull into the water during sailing;

(d) a weight attached to the daggerboard to lessen the tendency of the sailing craft to be unstable or flip during use; and (e) a shim removably mounted on the daggerboard and including a sleeve through which the daggerboard is inserted enabling placement of said sleeve into a slot formed in the hull, said shim including an upper flange adapted to rest on the hull upper surface in a covering position on the slot, and a pair of projections attached to extend transversely from opposite sides of the upper end of the daggerboard to rest on the flange.

4. The sailing craft of claim 3, wherein said shim is made of a resilient or elastomeric material preventing vibration of the daggerboard from being transmitted to the hull.

5. A daggerboard, comprising:

a daggerboard body formed with molded openings in an upper end thereof adapted to be manually grasped to carry or manipulate the daggerboard during use; and a weight attached to a lower end of the daggerboard.

6. A daggerboard, comprising:

a daggerboard body formed with a pair of projections extending transversely from an upper end of the daggerboard in co-axial alignment with each to define a pivot axis, said daggerboard further including a notch formed in the upper end thereof; and a tab made of a substantially rigid material loosely connected to the daggerboard upper end adjacent the notch.

7. A sailing craft comprising:

a hull;

a mast and sail mounted to project upward from the hull during sailing;

a hinge connecting the mast to the hull, said hinge including a first connection enabling movement of the mast and hull about the first connection only in the plane of the sail, and a second connection, separate from the first connection, connecting the hinge to the hull to permit rotation of the hinge about an axis extending upwardly from and perpendicular to the hull.

8. The sailing craft of claim 7, wherein said hinge includes a hinge block having a pair of arms defining a channel, and a hinge leaf pinned into the channel to form a hinge axis, said mast and sail being connectable to the hinge leaf which defines said first connection with said channel.

9. The sailing craft of claim 8, wherein said hinge leaf includes means, connectable to the mast, for defining said second connection.

10. A sailing craft comprising:

(a) a hull;

(b) a mast and sail mounted to project upward from the hull during sailing;

(c) a daggerboard removably mounted to project downward from the hull into the water during sailing;

(d) a weight attached to the daggerboard to lessen the tendency of the sailing craft to be unstable or flip during use; and (e) a shim removably mounted on the daggerboard and including a sleeve through which the daggerboard is inserted enabling placement of said sleeve into a slot formed in the hull, said shim including an upper flange adapted to rest on the hull upper surface in a covering position on the slot, and at least one projection being attachable to extend transversely from opposite sides of the upper end of the daggerboard to rest on the flange.

11. A daggerboard, comprising:

a daggerboard body formed with at least one opening in an upper end thereof adapted to be manually grasped to carry or manipulate the daggerboard during use; and a weight attached to a lower end of the daggerboard.

* * * * *